US005678152A

United States Patent [19]

Kohno et al.

[11] Patent Number: 5,678,152

[45] Date of Patent: Oct. 14, 1997

[54] FIXING DEVICE FOR FIXING A TONER IMAGE ON A TRANSFER MEDIUM BY HEATING AND PRESSING THE TONER IMAGE

[75] Inventors: Yuzou Kohno, Abiko; Hiroshi Kawano, Kawasaki; Masanori Matsuda, Yokohama; Satoshi Takanashi, Kawasaki, all of Japan

[73] Assignee: Ricoh Company, Ltd., Tokyo, Japan

[21] Appl. No.: 505,958

[22] Filed: Jul. 24, 1995

[30] Foreign Application Priority Data

Aug. 1, 1994 [JP] Japan ..... 6-180117

[51] Int. Cl.[6] ..... G03G 15/20

[52] U.S. Cl. ..... 399/324; 399/325

[58] Field of Search ..... 355/283, 284; 118/60, DIG. 2; 399/324, 325–327

[56] References Cited

U.S. PATENT DOCUMENTS

| | | | |
|---|---|---|---|
| 3,964,431 | 6/1976 | Namiki | 118/60 |
| 4,757,347 | 7/1988 | Tamaoki et al. | 355/284 |

FOREIGN PATENT DOCUMENTS

| | | |
|---|---|---|
| 55-7725 | 1/1980 | Japan . |
| 61-86776 | 5/1986 | Japan . |
| 61-221773 | 10/1986 | Japan . |
| 62-186170 | 11/1987 | Japan . |
| 1-135460 | 9/1989 | Japan . |
| 1-139266 | 9/1989 | Japan . |
| 2-28681 | 1/1990 | Japan . |
| 5-281871 | 10/1993 | Japan . |

*Primary Examiner*—William J. Royer

*Attorney, Agent, or Firm*—Oblon, Spivak, McClelland, Maier & Neustadt, P.C.

[57] ABSTRACT

In an image forming apparatus, a fixing device for fixing a toner image on a paper has an oil applying member for applying oil to a heat roller, and an impurity fixing member for fixing the impurities, including toner and paper dust, to the cleaning member. The impurities transferred from the applying member to the cleaning member are fixed to the cleaning member. As a result, the applying member suffers from a minimum of contamination and can be cleaned when contaminated. This obviates the reverse transfer of the contamination from the applying roller to the heat roller which would lower image quality.

10 Claims, 6 Drawing Sheets

CHARACTERISTIC OF APPLYING MEMBER 6

CHARACTERISTIC OF CLEANING MEMBER 7

CHARACTERISTIC OF IMPURITY FIXING MEMBER 8

FIXING DEVICE FOR FIXING A TONER IMAGE ON A TRANSFER MEDIUM BY HEATING AND PRESSING THE TONER IMAGE

BACKGROUND OF THE INVENTION

The present invention relates to a fixing device included in a copier, printer, facsimile apparatus or similar electrophotographic image forming apparatus and using a heat roller and, more particularly, to a fixing device of the type applying oil to a heat roller.

A fixing device having a heat roller and a press roller contacting each other is conventional and extensively used in an image forming apparatus of the kind described. The heat roller has a parting layer on the periphery thereof. The heat roller and press roller convey a transfer medium or paper carrying a toner image thereon by heating and pressing the toner image. This type of fixing device fixes toner mainly by melting it by the heat of the heat roller. However, the problem with the fixing device is that if the parting ability of the heat roller is short, the toner partly deposits on the heat roller and brings about so-called offset. To eliminate this problem, it has been customary to provide the heat roller with a parting layer and to apply silicone oil or similar parting agent to the roller. Implementations for applying the parting agent to the heat roller are disclosed in, for example, Japanese Patent Laid-Open Publication Nos. 61-109084, 62-5284 and 3-114064, and Japanese Utility Model Laid-Open Publication No. 1-120171. In one of them, an applying roller for applying oil to the heat roller is provided with a tank therein. A small amount of oil oozing out from the applying roller is supplied to the heat roller via felt. In another implementation, an applying roller is impregnated with viscous oil and held in contact with the heat roller. In still another implementation, use is made of an applying roller filled with oil and having a porous surface layer.

With any of the above applying rollers, the fixing device can apply oil to the heat roller in an even thin layer. This ensures a desirable parting ability and frees papers from oil stains due to excessive oil supply. However, although the parting ability may be improved, it is difficult to fully obviate the offset, i.e., a small amount of offset remains on the heat roller. Hence, even in the fixing device using the porous applying roller, impurities left on the heat roller and including toner and paper dust are transferred to the applying roller and sequentially contaminate it. The impurities, therefore, reduce the amount of oil supply from the applying roller during the course of repeated fixing operation. Moreover, the impurities are again transferred from the applying roller to the heat roller, thereby smearing papers.

In light of the above, we have proposed an applying member having a porous surface layer formed of the same material as the parting layer of the heat roller, and filled with oil. This kind of applying roller allows a minimum of toner to be transferred from the heat roller thereto and thereby reduces the load of the applying roller against contamination. Experiments showed that the margin against such contamination is further enhanced if use is made of a cleaning member contacting the applying member and provided, or not provided, with a surface layer formed of fluorine-based rubber. However, because this scheme simply transfers the impurities from the applying roller to the cleaning member at the position where the two rollers contact, the bond between the cleaning member and the impurities is too weak to obviate the reverse transfer of the impurities to the applying member.

To obviate the above reverse transfer, the cleaning member may be selectively brought into or out of contact with the applying member and may be done so while the heat roller is in rotation. However, a mechanism for moving the cleaning member into and out of contact with the applying member complicates the overall arrangement and increases the cost. This is also true when the cleaning member is moved during the course of rotation of the heat roller.

Technologies relating to the fixing device of an image forming apparatus are disclosed in, for example, Japanese Patent Laid-Open Publication Nos. 55-7725, 2-28681, 5-281871, 61-86776 and 61-221773, and Japanese Utility Model Laid-Open Publication Nos. 1-139266, 1-135460 and 62-186170.

SUMMARY OF THE INVENTION

It is, therefore, an object of the present invention to provide a fixing device for an image forming apparatus which allows a minimum of impurities to deposit on an oil applying member and allows the applying member to be cleaned when contaminated, thereby obviating the reverse transfer of the impurities to a heat roller which would lower image quality.

In accordance with the present invention, a device for fixing a toner image formed on a transfer medium by heating and pressing the toner has a fixing roller having a parting layer on the periphery thereof. A pressing member rotatably contacts the fixing roller. An oil applying member contacts the fixing member and is filled with oil to be applied to the fixing member. A cleaning member cleans the oil applying member. The transfer member with the toner image is nipped and conveyed by the fixing roller and pressing member for fixing the toner image. An impurity fixing member fixes impurities collected by the cleaning member to the cleaning member.

Also, in accordance with the present invention, a device for fixing a toner image formed on a transfer medium by heating and pressing the toner image has a fixing roller having a parting layer on the periphery thereof. A pressing member rotatably contacts the fixing roller. An oil applying member contacts the fixing member and is filled with oil to be applied to the fixing member. A cleaning member cleans the oil applying member. The transfer member with the toner image is nipped and conveyed by the fixing roller and pressing member for fixing the toner image. The oil applying member comprises a rotary body contacting the fixing roller, while the cleaning member comprising a rotary body contacting the oil applying member. The cleaning member is located such that a line connecting the axis of the fixing roller and the axis of the oil applying roller, and a line connecting the axis of the cleaning member and the axis of the oil applying member are perpendicular to each other.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
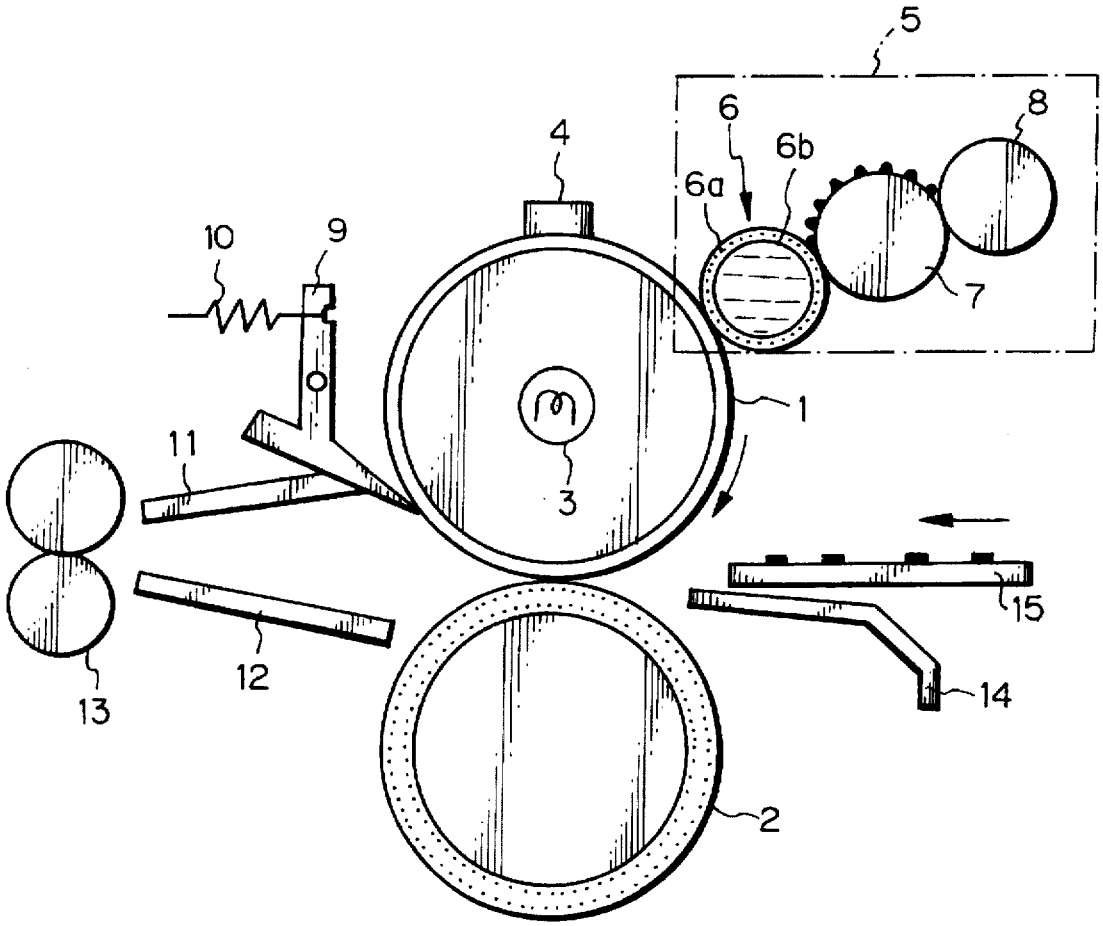
FIG. 1 is a section of a fixing device embodying the present invention.

Referring to FIG. 1 of the drawings, a fixing device embodying the present invention is shown and includes a heat roller 1 and a press roller 2. The heat roller 1 has a parting layer on the outer periphery thereof. The press roller 2 is held in pressing contact with the heat roller 1. A heater 3 is disposed in the heat roller 1. A thermistor 4 senses the surface temperature of the heat roller 1. An oil supply device 5 supplies oil to the heat roller 1 and has an oil applying member 6, a cleaning member 7, and an impurity fixing member 8. The applying member 6 contacts the heat roller 1 and applies oil thereto. The cleaning member 7 removes impurities, including toner and paper dust, from the applying member 6. The impurity fixing member 8 fixes the impurities collected by the cleaning member 7 on the same member 7. A separator 9 separates a paper having its toner image fixed thereon from the heat roller 1. The separator 9 is constantly urged against the heat roller 1 by a spring 10. An upper guide 11 and a lower guide 12 cooperate to guide the paper separated by the separator 9 to a discharge roller pair 13. An inlet guide 14 guides a paper 15, carrying a non-fixed toner image thereon, into the nip between the heat roller 1 and the press roller 2.

The heater 3 disposed in the heat roller 1 is controlled on the basis of the output of the thermistor 4 responsive to the surface temperature of the roller 1. As a result, the surface temperature of the heat roller 1 is maintained at a predetermined value. The press roller 2 has a surface layer formed of silicone rubber or similar heat-resistive elastic material. When the paper 15 is guided into the nip between the heat roller 1 and the press roller 2 by the inlet guide 14, it is heated and pressed by the heat roller 1 and press roller 2 with the result that the toner image is fixed on the paper 15. Thereafter, the paper 15 is separated from the heat roller 1 by the separator 9 and then driven out to a stacking unit, not shown, by the discharge roller pair 13.

The heat roller 1 is made up of a journalled portion, i.e., a metallic core or roller surface formed of aluminum, and the previously mentioned parting layer formed on the journalled portion and implemented by fluorine-contained resin. For example, the surface of the journalled portion is coated with PFA, PTFE or similar fluorine-contained resin which allows toner to part easily.

The oil supply device 5 is positioned at the inlet side of the fixing device. When the heat roller 1 is rotated, the applying member 6 and cleaning member 7 are rotated by the roller 1. Usually, when the paper 15 with the toner image is brought to the nip between the heat roller 1 and the press roller 2, the toner is melted by heat and fixed on the paper 15. However, when the parting ability of the heat roller 1 is short, the toner is partly transferred from the paper 15 to the roller 1, resulting in a small amount of offset. In light of this, the applying member 6, filled with silicone oil, is held in contact with the heat roller 1 and supplies the oil thereto. Although this arrangement improves the parting ability of the heat roller 1, it cannot fully obviate the offset, i.e., some offset remains on the heat roller 1. Therefore, the applying member 6 plays the role of a cleaning roller at the same time. In this condition, the applying member 6 is sequentially contaminated by the toner, paper dust and other impurities due to the repeated fixing operation. The impurities reduce the amount of oil supply from the applying member 6 to the heat roller 1. Moreover, the toner deposited on the applying member 6 is again transferred to the heat roller 1 and contaminates the paper 15.

To eliminate the above problems, in the illustrative embodiment, the applying member 6 is made up of a roller base 6*b* formed of a foam material, and a porous surface layer 6*a* formed of the same material as the parting layer of the heat roller 1, e.g., PTFE. The roller base 6*b* is filled with silicone oil. Because the surface layer 6*a* is implemented by the same material as the parting layer of the heat roller 1, the transfer of the toner from the roller 1 to the layer 6*a* is reduced. This, in turn, reduces the cleaning effect of the applying member 6 and, therefore, the load acting on the member 6. However, some impurities are still deposited on the applying member 6.

In the embodiment, the cleaning member 7 is rotatable in contact with the applying member 6. The cleaning member 7 is made up of a metallic roller and a surface layer formed thereon. The surface layer is implemented as a 10 μm to 100 μm thick coating of fluorine-contained rubber whose parting ability is lower than that of the surface layer of the applying member 6. With this configuration, the cleaning member 7 removes toner, paper dust and other impurities from the applying member 6.

Although the cleaning member 7 successfully extends the life of the applying member 6 against impurities, experiments showed that the impurities once collected by the member 7 are again transferred to the member 6 and contaminate it due to the repeated operation. This occurs for the following reasons. Because the cleaning member 7 simply collects the impurities on the basis of the difference in parting ability between it and the applying member 6, the bond between the impurities and the member 7 is weak. As a result, the impurities form masses projecting from the surface of the cleaning member 7. In this condition, a higher pressure acts on the projecting portions of the cleaning member 7 than on the other portions, or the contact area increases in the projecting portions. The impurities, therefore, concentrate more on the projecting portions than on the other portions and sequentially grow, so that the surface of the cleaning member 7 becomes irregular.

Figure 4:
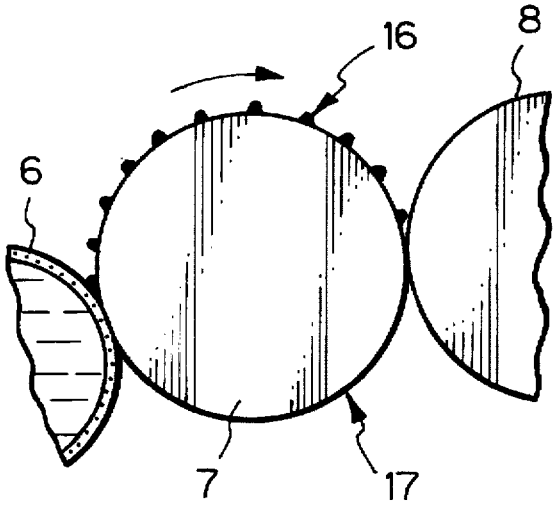
FIG. 4 is an enlarged section of a cleaning member also included in the oil supply device.

In light of the above, the embodiment further includes the impurity fixing member 8 which follows the rotation of the cleaning member 7. The member 8 presses the impurities deposited on the cleaning member 7, while leveling the surface of the member 7. This successfully prevents the impurities from being transferred from the cleaning member 7 to the applying member 6. In addition, the member 8 reduces the volume of the impurities on the cleaning member 7 by pressing them together. As a result, the amount of impurities which can be collected by the cleaning member 7 and, therefore, the life of the member 7 is increased. Specifically, as shown in FIG. 4, impurities 16, including toner and paper dust and collected by the cleaning member 7 from the applying member 6, are pressed by the member 8 and form a uniform layer 17.

Figure 2:
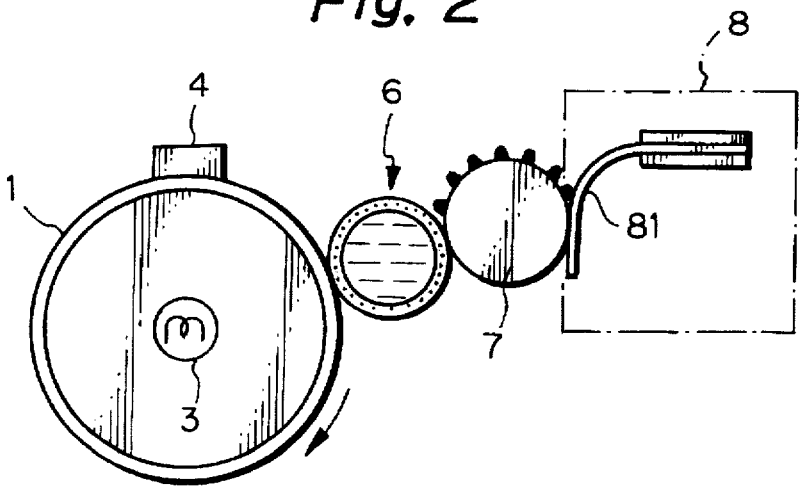
FIGS. 2 and 3 are sections each showing another specific configuration of an impurity fixing member included in an oil supply device forming part of the embodiment.
Figure 3:
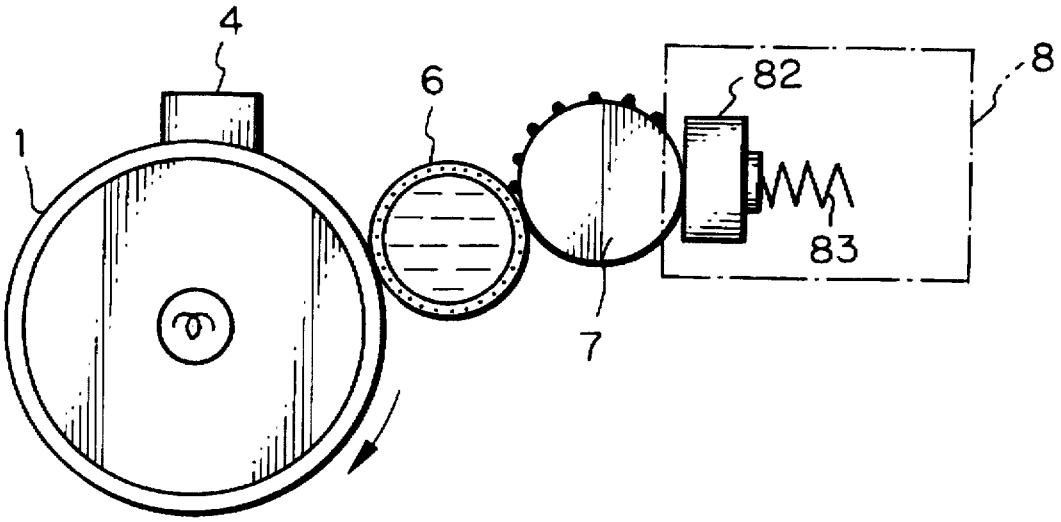

FIG. 2 shows another specific configuration of the impurity fixing member 8. As shown, the member 8 is implemented as an elastic film 81 and pressed against the cleaning member 7 while following the direction of rotation of the member 7. The elastic film 81 is 50 μm to 200 μm thick and made of polyimide resin or similar resin. FIG. 3 shows still another specific configuration of the member 8. As shown, a stationary fixing member 82 is constantly urged against the cleaning member 7 by a spring 83.

In an alternative embodiment of the present invention, the surface layer of the impurity fixing member 8 is made, for example, PTFE, PFA or similar fluorine-contained resin, while the surface layer of the cleaning member 7 is again made of fluorine-contained rubber. In this configuration, the surface of the fixing member 8 has a parting ability superior to that of the surface of the cleaning member 7. This obviates an occurrence that the impurities form masses on the member 8 and shave the surface of the member 7 to thereby bring about fine smears.

In another alternative embodiment, the surface layer of the impurity fixing member 8 is provided with conductivity by use of metal, metal plating, or conductive filler. The conductive surface layer prevents static electricity from being generated between the members 8 and 7 due to friction. The static electricity would cause fine particles present in the impurities to fly about and contaminate the cleaning member 7.

Figure 5:
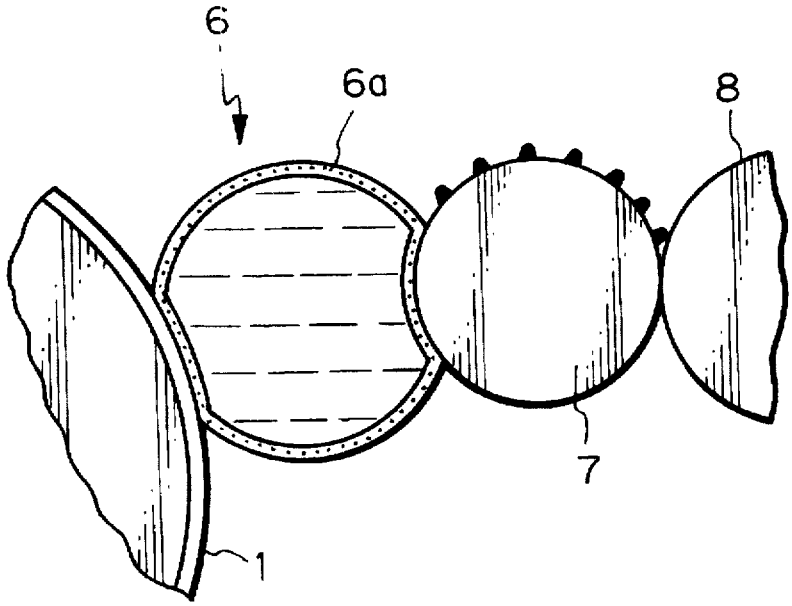
FIGS. 5 and 6 are fragmentary sections each showing an alternative embodiment of the present invention.

In another alternative embodiment, the cleaning member 7 is provided with a higher surface hardness than the applying member 6. This eliminates an occurrence that the impurities pressed together by the impurity fixing member 8 come off due to the deformation of the cleaning member 7 and deposit on the applying member 6. Specifically, as shown in FIG. 5, at the position where the members 6 and 7 contact each other, the member 6 is deformed, but the member 7 is not deformed. As a result, the impurities are prevented from coming off the cleaning member 7.

In another alternative embodiment, the impurity fixing member 8 is provided with a smaller surface roughness than the cleaning member 7. In this condition, the impurities are prevented from turning out fine particles due to friction between the members 7 and 8. Hence, the member 8 is free from contamination.

Figure 6:
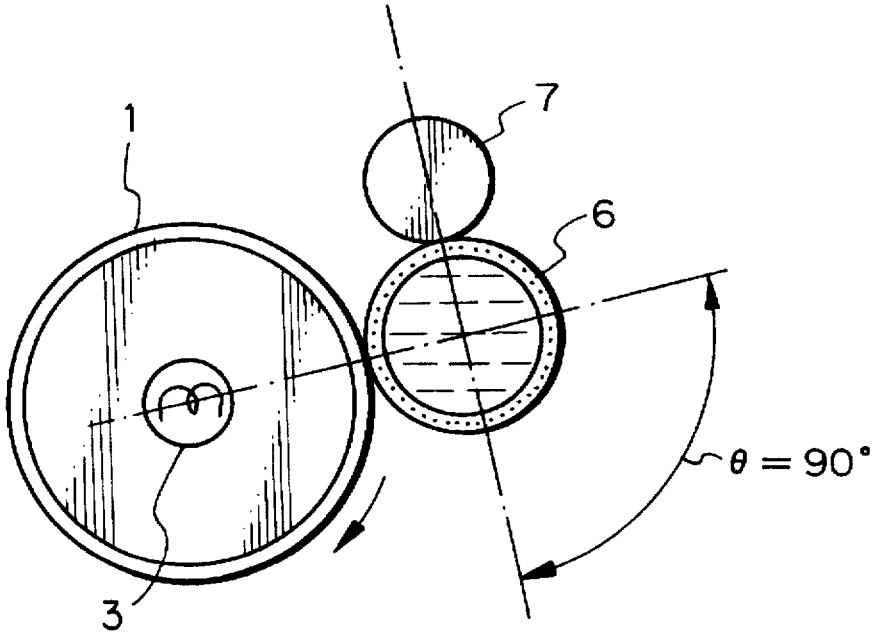
Figure 7:
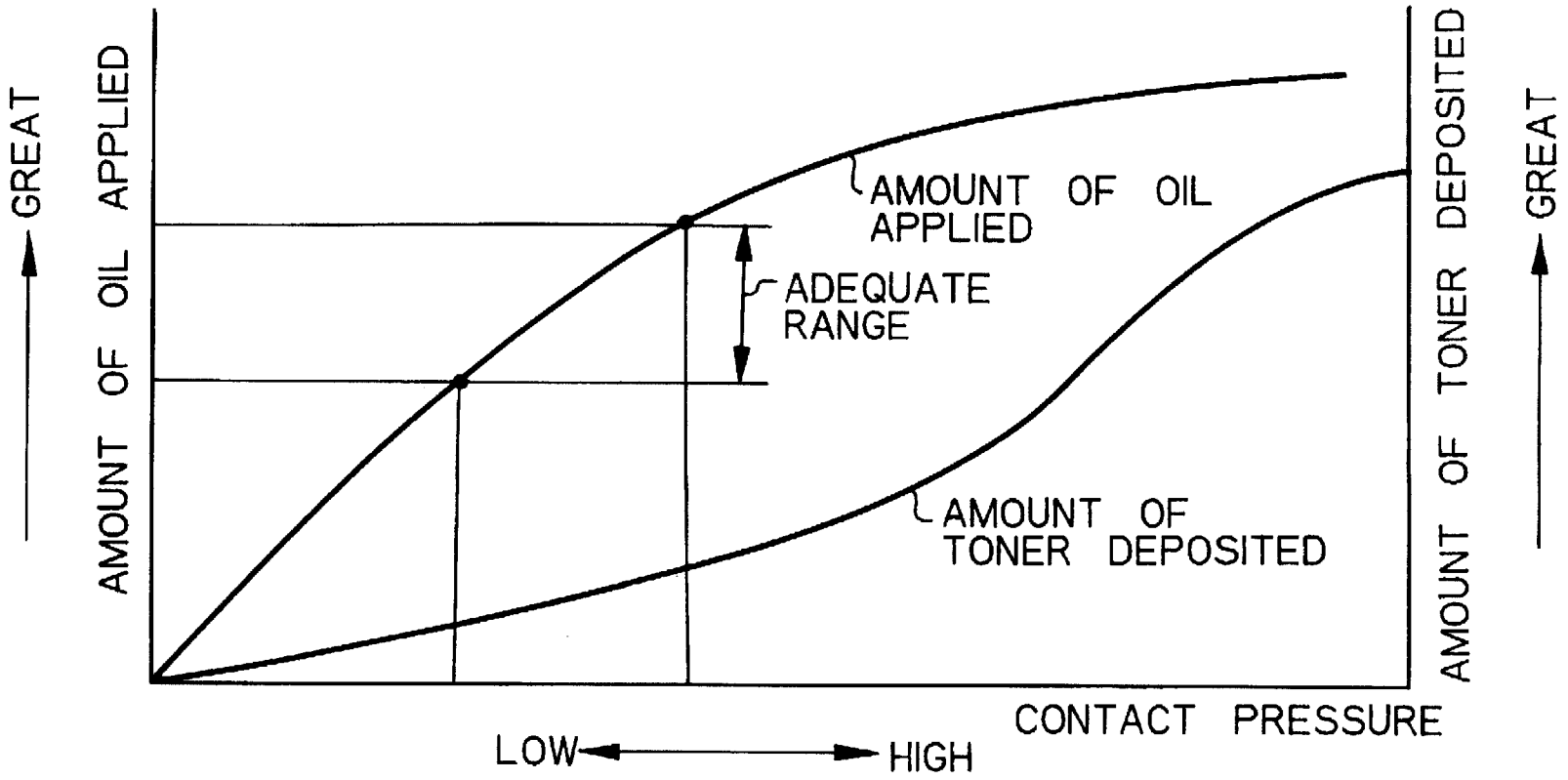
FIG. 7 is a graph representative of the characteristic of an oil applying member included in the illustrative embodiments.
Figure 8:
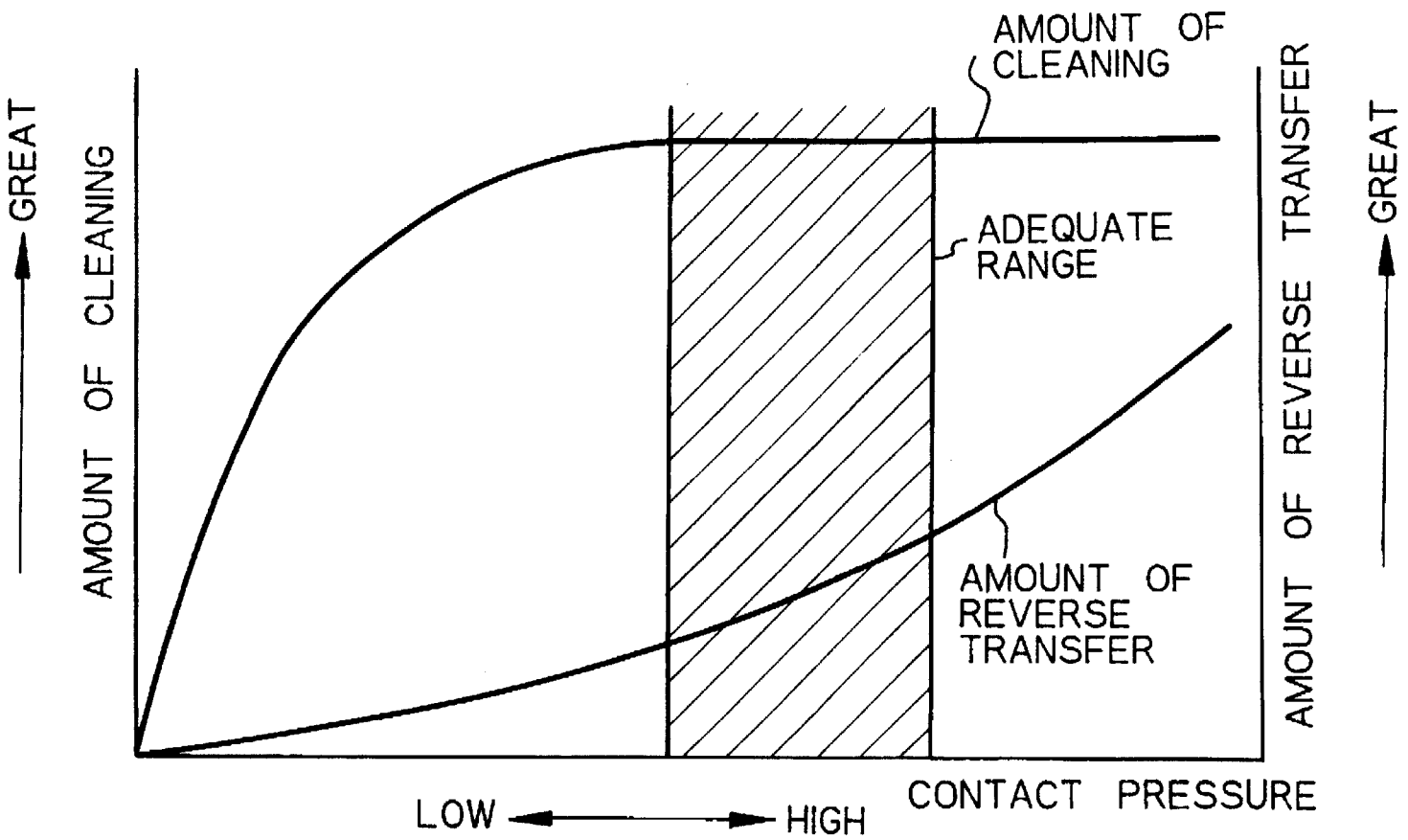
FIG. 8 is a graph representative of the characteristic of the cleaning member of the embodiments.

Referring to FIG. 6, still another alternative embodiment of the present invention will be described. Part of this embodiment identical with the embodiment of FIG. 1 is not shown or described. As shown, the applying member in the form of a roller 6 is held in contact with a cleaning member in the form of a roller 7 and with the heat roller 1. FIG. 7 shows the characteristic of the applying roller 6. As shown, as the contact pressure of the roller 6 increases, the amount of application of oil and the amount of deposition of toner, or impurity, change. The amount of toner deposition should be as small as possible. By contrast, the amount of oil application should be confined in an adequate range. The excessive application of oil would bring about contamination while the short application of oil would lower the parting ability of the heat roller 1 and thereby contaminate it. FIG. 8 shows the characteristic of the cleaning roller 7. As shown, the amount of cleaning available with the roller 7 and the amount of reverse transfer from the roller 7 to the roller 6 each changes with a change in the contact pressure of the roller 7. To maximize the amount of cleaning and to reduce the amount of reverse transfer, there exists an adequate range indicated by hatching in FIG. 8.

Considering the characteristics shown in FIGS. 7 and 8, this embodiment arranges the rollers 1, 6 and 7 such that the line connecting the axis of the roller 6 and that of the roller 1 and the line connecting the axis of the roller 6 and that of the roller 7 are substantially perpendicular to each other, as shown in FIG. 6. This kind of arrangement allows the pressure with which the roller 6 contacts the roller 1 and the pressure with which the roller 7 contacts the roller 6 to be selected independently of each other. Moreover, such pressures can each be selected in the respective adequate range stated above. Of course, the impurity fixing member 8 shown in FIG. 1, 2 or 3 may be combined with the cleaning roller 7 shown in FIG. 6.

Figure 9:
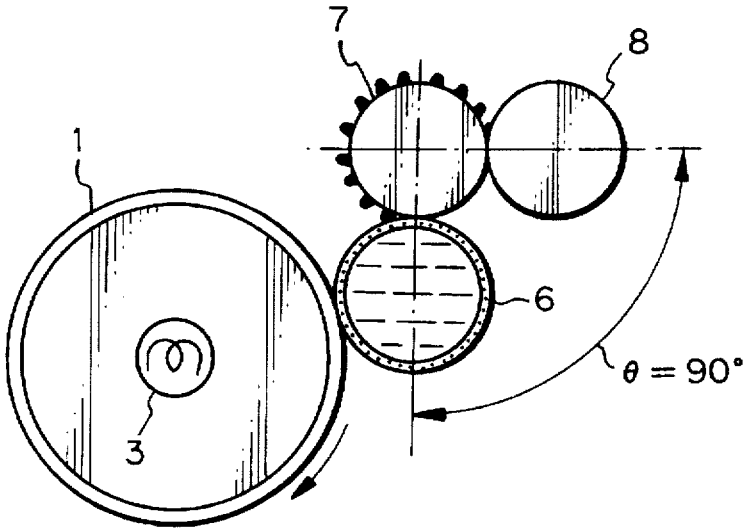
FIG. 9 is a fragmentary section showing a further alternative embodiment of the present invention.
Figure 10:
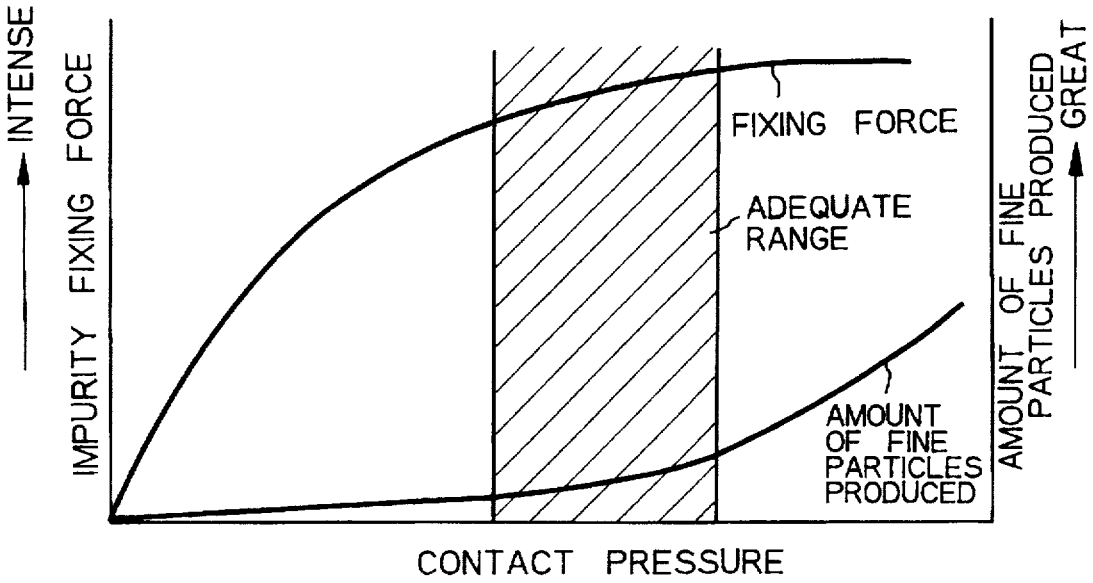
FIG. 10 is a graph representative of the characteristic of an impurity fixing member also included in the embodiments.

A further alternative embodiment of the present invention is shown in FIG. 9. Part of this embodiment identical with the embodiment of FIG. 1 is not shown or described. As shown, the applying roller 6 is held in contact with the heat roller 1 and driven thereby. The cleaning roller 7 is held in contact with the applying roller 6 and impurity fixing roller 8. Again, the rollers 6 and 7 have the characteristics described with reference to FIGS. 7 and 8, respectively. FIG. 10 shows the characteristic of the impurity fixing roller 8. As shown, as the contact pressure of the roller 8 increases, the force of the roller 8 for fixing the impurities on the roller 7 and the amount of fine particles to be produced at the position where the roller 8 contacts the roller 7 change. There is selected an adequate range in which the impurity fixing force is acceptable and the amount of fine particles is small, as indicated by hatching in FIG. 10.

Considering the above, this embodiment locates the impurity fixing member 8 such that the line connecting the axes of the rollers 7 and 6 and the line connecting the axes of the rollers 7 and 8 are substantially perpendicular to each other, as shown in FIG. 9. This kind of arrangement allows the pressure with which the roller 7 contacts the roller 6 and the pressure with which the roller 8 contacts the roller 7 to be selected independently of each other. Moreover, such pressures can each be selected in the respective adequate range stated above.

In summary, it will be seen that the present invention provides a fixing device for an image forming apparatus and having various unprecedented advantages, as enumerated below.

(1) Impurities, including toner and paper dust are transferred from an oil applying member to a cleaning member, and fixed on the cleaning member. Hence, the reverse transfer of the impurities from the cleaning member to the applying member is noticeably reduced, so that the applying member remains clean. It follows that the applying member suffers from a minimum of contamination. In addition, because the applying member can be cleaned, the reverse transfer of the impurities to a heat roller is obviated. The device, therefore, prevents image quality from being lowered.

(2) Irregularities on the surface layer of an impurity fixing member attributable to the impurities are reduced, so that the surfaces of impurities on the cleaning member are not disturbed. As a result, the reverse transfer of impurities from the cleaning member to the applying member is further reduced.

(3) Static electricity is prevented from being generated by friction between the impurity fixing member and the cleaning member. This prevents fine particles, contained in the impurities fixed on the cleaning member, from flying about or electrostatically depositing on the other members. The applying member is, therefore, free from contamination attributable to reverse transfer.

(4) Because the cleaning member deforms little at the position where it contacts the applying member, the impurities are prevented from coming off due to the deformation of the cleaning member. This protects the applying member from contamination attributable to reverse transfer.

(5) When the impurities are fixed on the cleaning member, they turn out a minimum of fine particles at the position where the cleaning member and fixing member contact. This also protects the applying member from contamination.

(6) The contact pressure between the heat roller and the applying member and the contact pressure between the applying member and the cleaning member can be selected independently of each other. Hence, an optimal pressure for oil application and an optimal pressure for cleaning are achievable at the same time. The applying member, therefore, suffers from a minimum of contamination and can be cleaned when contaminated. As a result, the reverse transfer of contamination to the heat roller is eliminated. This guarantees desirable image quality.

(7) The contact pressure between the applying member and the cleaning member and the contact pressure between the cleaning member and the impurity fixing member can be selected independently of each other. Hence, the reverse transfer of contamination to the heat roller is obviated to ensure high image quality more positively.

Various modifications will become possible for those skilled in the art after receiving the teachings of the present disclosure without departing from the scope thereof.

What is claimed is:

1. A device for fixing a toner image formed on a transfer medium by heating and pressing the toner image, comprising:

a fixing roller having a parting layer on a periphery thereof;

a pressing member rotatably contacting said fixing roller;

an oil applying member contacting said fixing roller and filled with oil to be applied to said fixing roller;

a cleaning member for cleaning said oil applying member; and an impurity fixing member for fixing impurities collected by said cleaning member to said cleaning member, wherein said transfer medium being nipped and conveyed by said fixing roller and said pressing member has the toner image fixed thereon.

2. A device as claimed in claim 1, wherein said oil applying member comprises a porous surface layer formed of a same material as said parting layer of said fixing roller.

3. A device as claimed in claim 1, wherein at least a surface layer of said impurity fixing member is formed of a material superior in parting ability to a surface layer of said cleaning member.

4. A device as claimed in claim 1, wherein at least a surface layer of said impurity fixing member is formed of a conductive material.

5. A device as claimed in claim 1, wherein said cleaning member has a higher surface hardness than said oil applying member.

6. A device as claimed in claim 1, wherein said impurity fixing member has a smaller surface roughness than said cleaning member.

7. A device as claimed in claim 1, wherein said oil applying member comprises a rotary body contacting said fixing roller, wherein said cleaning member comprises a rotary body contacting said oil applying member, and wherein said impurity fixing member is located such that a line connecting an axis of said cleaning member and an axis of said oil applying member, and a line connecting the axis of said cleaning member and a point where said cleaning member and said fixing roller contact are perpendicular to each other.

8. A device for fixing a toner image formed on a transfer medium by heating and pressing the toner image, comprising:

a fixing roller having a parting layer on a periphery thereof;

a pressing member rotatably contacting said fixing roller;

an oil applying member comprising a rotary body contacting said fixing roller and filled with oil to be applied to said fixing roller; and a cleaning member for cleaning said oil applying member, said cleaning member comprising a rotary body contacting said oil applying member and being located such that a line connecting an axis of said fixing roller and an axis of said oil applying member, and a line connecting an axis of said cleaning member and the axis of said oil applying member are perpendicular to each other, said transfer member being nipped and conveyed by said fixing roller, and said pressing member having the toner image fixed thereon.

9. A device as claimed in claim 8, wherein said oil applying member comprises a porous surface layer formed of a same material as said parting layer of said fixing roller.

10. A device as claimed in claim 8, further comprising an impurity fixing member located such that a line connecting an axis of said cleaning member and an axis of said oil applying member, and a line connecting the axis of said cleaning member and a point where said cleaning member and said impurity fixing member contact are perpendicular to each other.

* * * * *